US010188194B2

(12) United States Patent
Kim

(10) Patent No.: US 10,188,194 B2
(45) Date of Patent: Jan. 29, 2019

(54) TWISTED COSMETIC BRUSH

(71) Applicant: AA R&D LLC, Leonia, NJ (US)

(72) Inventor: Yoon-Hoi Kim, Fort Lee, NJ (US)

(73) Assignee: AA R&D LLC, Leonia, NJ (US)

( * ) Notice: Subject to any disclaimer, the term of this patent is extended or adjusted under 35 U.S.C. 154(b) by 0 days.

(21) Appl. No.: 14/674,782

(22) Filed: Mar. 31, 2015

(65) Prior Publication Data

US 2015/0327655 A1 Nov. 19, 2015

Related U.S. Application Data

(63) Continuation of application No. 14/298,080, filed on Jun. 6, 2014.

(60) Provisional application No. 61/990,767, filed on May 9, 2014.

(51) Int. Cl.

| | |
|---|---|
| ***A45D 40/26*** | (2006.01) |
| ***A45D 19/00*** | (2006.01) |
| ***A46B 3/00*** | (2006.01) |
| ***A46B 9/02*** | (2006.01) |

(52) U.S. Cl.

CPC ..... *A45D 40/262* (2013.01); *A45D 19/0008* (2013.01); *A46B 3/005* (2013.01); *A46B 9/021* (2013.01); *A46B 9/023* (2013.01); *A46B 2200/1053* (2013.01)

(58) Field of Classification Search

CPC ..... A45D 40/265; A45D 40/26; A46B 9/028; A46B 9/021; A46B 2200/1053; A46B 2200/106; A46B 3/18

USPC ..... 132/218, 320; 401/129, 122, 127, 126; 15/188, 207.2, 159, 187

See application file for complete search history.

(56) References Cited

U.S. PATENT DOCUMENTS

| | | | | |
|---|---|---|---|---|
| 4,404,977 | A * | 9/1983 | Vasas | 132/218 |
| 4,635,659 | A * | 1/1987 | Spatz | 132/218 |
| 8,920,058 | B2 * | 12/2014 | Simard | A46B 5/0054 132/218 |
| 2008/0023020 | A1 | 1/2008 | Gueret | |
| 2008/0219748 | A1 * | 9/2008 | Salciarini | 401/129 |
| 2008/0245382 | A1 * | 10/2008 | Marciniak-Davoult | A45D 40/265 132/200 |
| 2009/0014022 | A1 * | 1/2009 | Salciarini | 132/200 |
| 2010/0089415 | A1 * | 4/2010 | Vandromme | A45D 40/262 132/218 |

(Continued)

FOREIGN PATENT DOCUMENTS

| | | | |
|---|---|---|---|
| CN | 101103858 | A | 1/2008 |
| CN | 201523794 | U | 7/2010 |

(Continued)

OTHER PUBLICATIONS

Office Action dated Jul. 5, 2016, issued in counterpart Japanese Application No. 2016-518028, with English translation (10 page).

(Continued)

*Primary Examiner* — Rachel R Steitz

(74) *Attorney, Agent, or Firm* — Westerman, Hattori, Daniels & Adrian, LLP

(57) ABSTRACT

A cosmetic brush that includes a plurality of polymer bristles that extend from a polymer core in a radial direction, wherein at least a portion of the core is twisted and bristles in the twisted portion are arranged in one or more columns disposed in one or more spiral paths that extend along at least a portion of the longitudinal axis of the core is presented.

16 Claims, 4 Drawing Sheets

(56) References Cited

U.S. PATENT DOCUMENTS

| | | | | |
|---|---|---|---|---|
| 2010/0294299 | A1* | 11/2010 | Gueret | A45D 34/042 132/218 |
| 2011/0284021 | A1* | 11/2011 | Gueret | A45D 40/24 132/218 |
| 2011/0297175 | A1 | 12/2011 | Pires et al. | |
| 2011/0299913 | A1* | 12/2011 | Simard et al. | 401/268 |
| 2013/0104925 | A1 | 5/2013 | Caulier | |
| 2013/0195539 | A1* | 8/2013 | Fontaine | A45D 40/262 401/129 |
| 2013/0315647 | A1 | 11/2013 | Gueret | |
| 2013/0333719 | A1* | 12/2013 | Pires et al. | 132/320 |
| 2014/0105667 | A1 | 4/2014 | Castex et al. | |

FOREIGN PATENT DOCUMENTS

| | | | | |
|---|---|---|---|---|
| CN | 201814090 | U | 5/2011 | |
| JP | 2008-006295 | A | 1/2008 | |
| JP | 2008-6295 | A | 1/2008 | |
| JP | 2010-221040 | A | 10/2010 | |
| JP | 2013-85572 | A | 5/2013 | |
| WO | 2011/152927 | A1 | 12/2011 | |
| WO | WO 2013153525 | A1 * | 10/2013 | A45D 40/265 |

OTHER PUBLICATIONS

European Search Report dated Oct. 20, 2015 issued in counterpart European Patent Application No. 14825241.4, (3 pages).

Office Action dated Dec. 30, 2016, issued in counterpart Korean Application No. 10-2014-0112151 with English translation. (6 pages).

Notice of Preliminary Rejection dated May 23, 2016, issued in counterpart Korean Patent Application No. 10-2014-0112151, with English translation. (14 pages).

Office Action dated Oct. 17, 2017, issued in counterpart Japanese Application No. 2016-518028, with English machine translation. (6 pages).

Office Action dated Aug. 1, 2017, issued in counterpart Chinese Application No. 201410450157.4, with English translation. (11 pages).

Office Action dated Jul. 28, 2017, issued in counterpart Korean Application No. 10-2014-0112151, with English translation. (3 pages).

Office Action dated Mar. 7, 2017, issued in counterpart Japanese Application No. 2016-518028 with English translation. (7 pages).

International Search Report and Written Opinion dated Oct. 27, 2014, for Application No. PCT/US2014/041287.

* cited by examiner

TWISTED COSMETIC BRUSH

This application is a Continuation of U.S. patent application Ser. No. 14/298,080, filed Jun. 6, 2014, which claims the benefit of U.S. Provisional Patent Application No. 61/990,767, filed on May 9, 2014, the contents of which are incorporated herein by reference.

FIELD OF THE DISCLOSED SUBJECT MATTER

The present invention relates to a cosmetic brush. More specifically, the present invention relates to a cosmetic brush having at least a partial spiral or helical arrangement of bristles.

BACKGROUND

Cosmetic brushes for applying a cosmetic composition to hair include, as examples, mascara brushes and hair coloring brushes. In general, there are three types of mascara brushes—volumizing, curling, and lengthening. Out of these, volumizing mascara brushes are the most in demand. Long bristles with large overall brush diameter and bristles oriented in random directions hold the most bulk which is needed to make the lashes look thick and voluminous. Traditional twisted nylon mascara brushes were previously the best choice for volumizing mascaras because of their randomness and no limitation on the brush diameter. However, the drawback of this brush is that the randomness in the brush is too random, which leads to a great deal of clumping of the bulk with clumps of bulk applied on the eyelashes. In order to solve the clumping issue, the industry developed molded mascara brushes which have bristles aligned in a consistent manner so that the clumping is reduced. However, due to technical limitations, bristles had to be arranged in an orderly fashion leading to less volume effect. Therefore, a need exists for volumizing mascara brushes that also provide reduced clumping of mascara.

SUMMARY OF THE DISCLOSED SUBJECT MATTER

There is provided in accordance with various embodiments a cosmetic brush that includes a plurality of polymer bristles that extend from a polymer core in a radial direction, wherein at least a portion of the core is twisted and bristles in the twisted portion are arranged in one or more columns disposed in one or more spiral or helical paths that extend about at least a portion of the longitudinal axis of the core. In an embodiment, the configuration of the spiral or helical path is maintained without external means.

In at least one embodiment, the polymer bristles are integrally molded with the polymer core.

In at least one embodiment, each column on the core is disposed in a separate spiral or helical path that extends about at least a portion of the longitudinal axis of the core. In at least one embodiment, none of the column paths intersect.

In at least one embodiment, the cosmetic brush further includes one or more columns of bristles disposed in one or more straight paths that extend parallel to at least a portion of the longitudinal axis of the core. In at least one embodiment, none of the column paths intersect.

DETAILED DESCRIPTION

Figure 1:
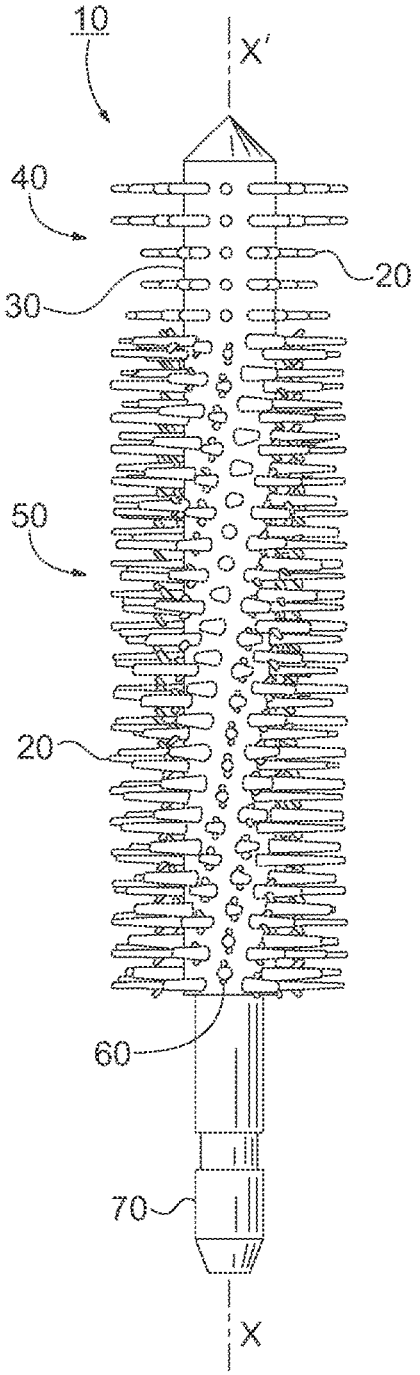
FIG. 1 is a side view of a cosmetic brush in accordance with an exemplary embodiment of the invention with at least a portion of the bristles having a 90 degree twist angle.

The present disclosure provides polymer cosmetic brushes having randomized bristles. Cosmetic brushes according to the present disclosure provide an improved degree of volumization over standard thermoplastic brushes and also reduce clumping that is associated with traditional nylon and wire brushes.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

As used herein, the term "cosmetic brush" includes, but is not limited to, mascara brushes and hair coloring brushes. Cosmetic brushes disclosed herein include a core member with at least one twist angle greater than zero degrees. In general, the twist angle is measured between two bristles in different rows, namely the bristles in the upper most and lower most rows within the twisted portion. In an untwisted arrangement, the twist angle between the two bristles is zero, i.e. the bristle column is substantially parallel to a longitudinal axis of the core. In a twisted arrangement, the twist angle between the same two bristles is greater than zero. In one embodiment, the twist angle is from about 1 degree to about 360 degrees. Any specific angle within this range is suitable (e.g., 2 degrees, 3 degrees, 4 degrees, 5 degrees, 10 degrees, 20 degrees, 30 degrees, 40 degrees, etc.). It is further contemplated that the twist angle may be greater than 360 degrees. It is contemplated that the entire core possesses at least one twist angle, however, it is also possible that a portion of the core is twisted while another portion is not. It is further contemplated that the core may include more than one twist angle such that a portion of the bristles extend at a first twist angle and another portion of the bristles extend at a second, distinct twist angle.

The core member extends along a longitudinal axis XX' and may have any suitable cross-sectional shape. Exemplary shapes for the core member includes, but are not limited to, circular, oval, triangular, square, trapezoidal, hexagonal, and the like. The bristles can also have any suitable cross-sectional shape (e.g. circular, oval, triangular, square, trapezoidal, hexagonal, etc.). The bristles can also be round or flat.

The cosmetic brushes are manufactured from a polymer material, which may include synthetic or semi-synthetic materials. Preferably, both the core and the bristles are manufactured from a thermoplastic material; however, the invention is not limited to such. One or both of the core and bristles may be manufactured from a different material. Additionally, the core and bristles are preferably manufactured from the same material; however, the may be manufactured from different materials from one another.

The cosmetic brushes according to the invention can be fabricated according to any suitable method. In one exemplary method, a thermoplastic brush is initially molded (e.g. via injection molding, extrusion, or the like) with the bristles formed integrally with the core in parallel, non-twisted columns. At least a portion of the molded core is then twisted via an application of force, heat, wind, chemicals, or a combination thereof, that results in a permanent deformation (e.g. twisting) of the core with the bristles in the twisted area extending in spiral or helical columns.

Figure 2:
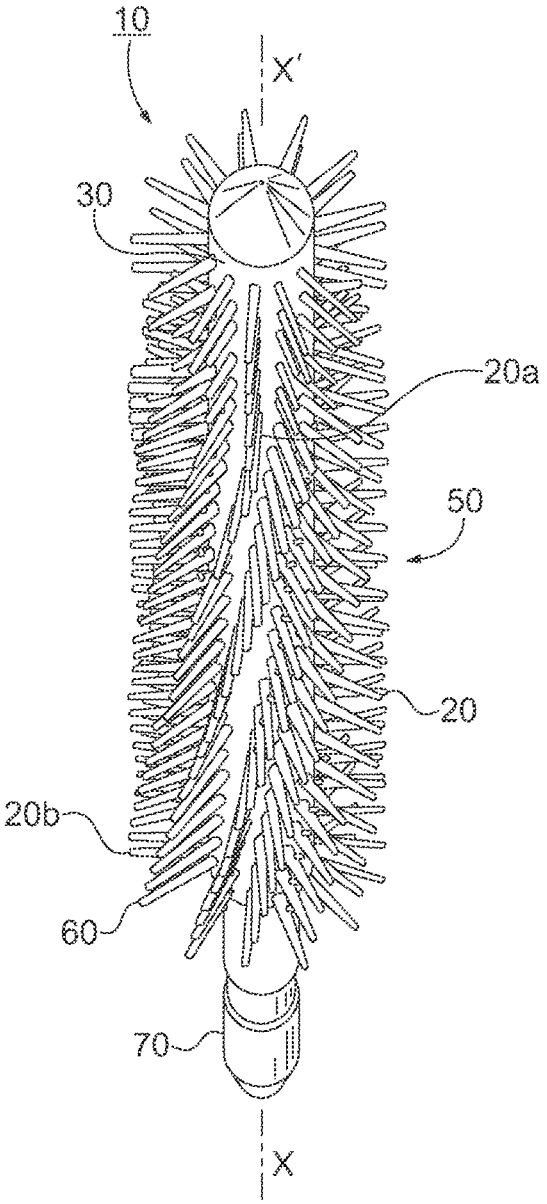
FIG. 2 is a perspective view of the cosmetic brush of FIG. 1.

Referring to FIGS. 1 and 2, a cosmetic brush 10 in accordance with an exemplary embodiment of the invention will be described. The brush 10 includes a plurality of polymer bristles 20 that extend from a polymer core 30 in a radial direction. In this embodiment, the core 30 includes a twisted portion 50 having a twist angle of approximately 90 degrees. Bristles 20 in the twisted portion 50 are arranged in multiple columns disposed in multiple spiral or helical paths 60 that extend about a portion of the longitudinal axis XX' of the core 30. None of the spiral/helical paths intersect. As illustrated in FIG. 2, the upper most bristle 20*a* in the twisted portion 50 is offset from the lower most bristle 20*b* in the twisted portion 50 by about 90 degrees.

In the illustrated embodiment, the core 30 also includes an untwisted portion 40 in which the core 30 is not twisted and the bristles 20 are disposed in multiple straight paths that extend generally parallel to the longitudinal axis XX' of the core 30. The opposite end of the core 30 may optionally include a stem 70. The stem 70 facilitates connection of the cosmetic brush to a handle or the like (not shown).

The view presented in FIG. 1 provides a view of the bristles 20 as randomized in the twisted portion 50. The view presented in FIG. 2 provides a view of the bristles 20 as disposed in multiple spiral or helical paths that extend about a portion of the longitudinal axis XX' of the core 30. As such, it can be said that the bristles 20 have an organized randomness.

Figure 3:
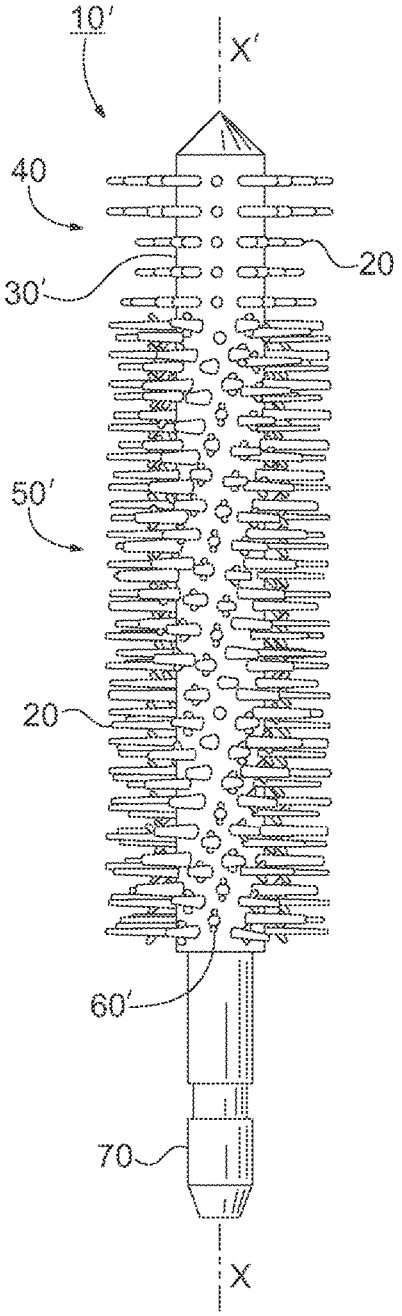
FIG. 3 is a side view of a cosmetic brush in accordance with another exemplary embodiment of the invention with at least a portion of the bristles having a 180 degree twist angle.
Figure 4:
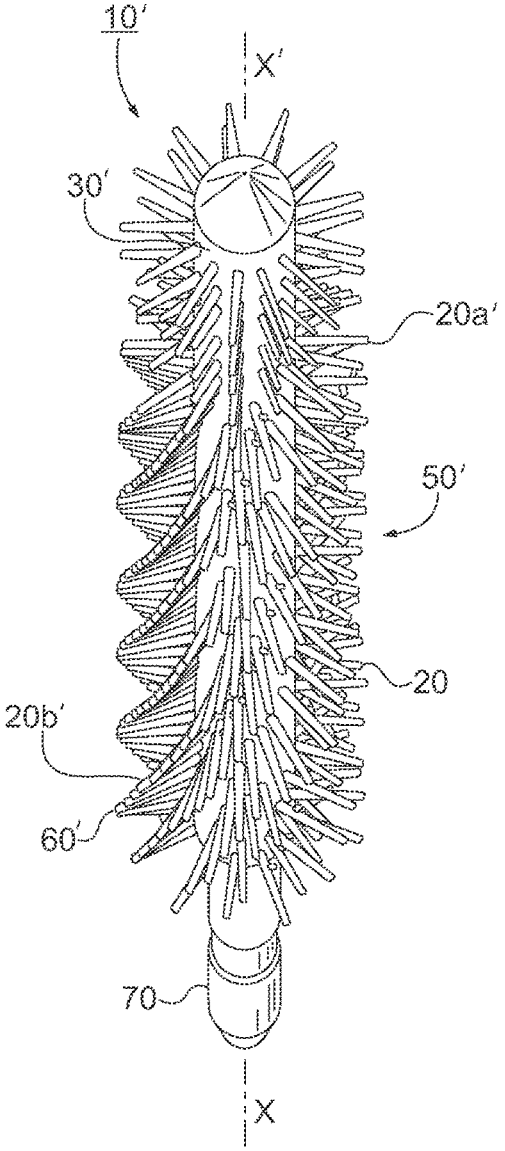
FIG. 4 is a perspective view of the cosmetic brush of FIG. 3.

Referring to FIGS. 3 and 4, a cosmetic brush 10' in accordance with another exemplary embodiment of the invention will be described. The brush 10' includes a plurality of polymer bristles 20 that extend from a polymer core 30' in a radial direction. In this embodiment, the core 30' includes a twisted portion 50' having a twist angle of approximately 180 degrees. Bristles 20 in the twisted portion 50' are arranged in multiple columns disposed in multiple spiral or helical paths 60' that extend about a portion of the longitudinal axis XX' of the core 30'. None of the spiral/helical paths intersect. As illustrated in FIG. 4, the upper most bristle 20*a'* in the twisted portion 50' is offset from the lower most bristle 20*b'* in the twisted portion 50' by about 180 degrees.

In the illustrated embodiment, the core 30' also includes an untwisted portion 40 in which the core 30' is not twisted and the bristles 20 are disposed in multiple straight paths that extend generally parallel to the longitudinal axis XX' of the core 30'. The opposite end of the core 30' may optionally include a stem 70. The stem 70 facilitates connection of the cosmetic brush to a handle or the like (not shown).

The view presented in FIG. 3 provides a view of the bristles 20 as randomized in the twisted portion 50'. The view presented in FIG. 4 provides a view of the bristles 20 as disposed in multiple spiral or helical paths that extend about a portion of the longitudinal axis XX' of the core 30'. As such, it can be said that the bristles 20 have an organized randomness.

Figure 5:
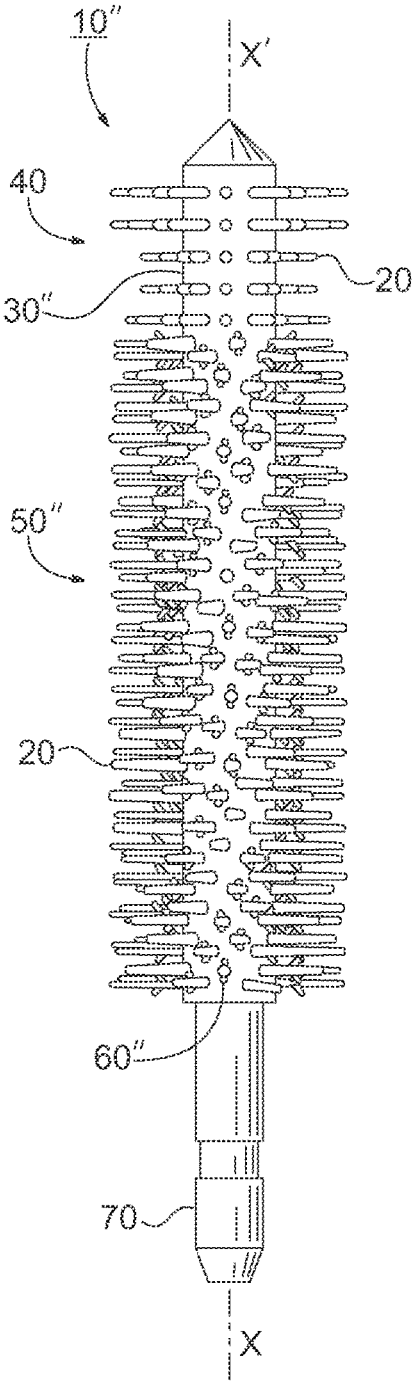
FIG. 5 is a side view of a cosmetic brush in accordance with another exemplary embodiment of the invention with at least a portion of the bristles having a 270 degree twist angle.
Figure 6:
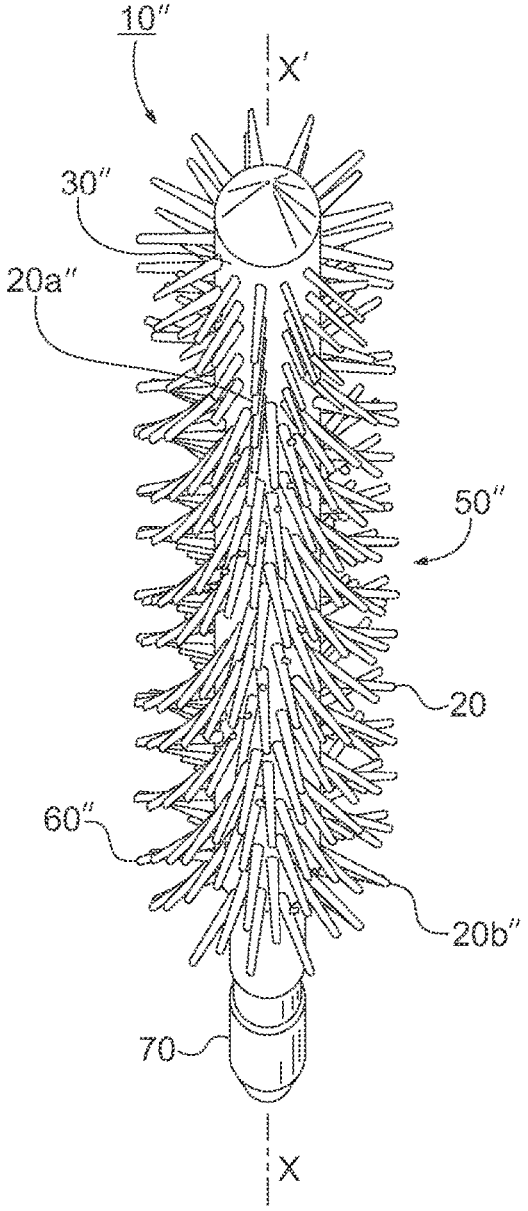
FIG. 6 is a perspective view of the cosmetic brush of FIG. 5.

Referring to FIGS. 5 and 6, a cosmetic brush 10" in accordance with another exemplary embodiment of the invention will be described. The brush 10" includes a plurality of polymer bristles 20 that extend from a polymer core 30" in a radial direction. In this embodiment, the core 30" includes a twisted portion 50" having a twist angle of approximately 270 degrees. Bristles 20 in the twisted portion 50" are arranged in multiple columns disposed in multiple spiral or helical paths 60" that extend about a portion of the longitudinal axis XX' of the core 30". None of the spiral/helical paths intersect. As illustrated in FIG. 6, the upper most bristle 20*a"* in the twisted portion 50" is offset from the lower most bristle 20*b"* in the twisted portion 50" by about 270 degrees.

In the illustrated embodiment, the core 30" also includes an untwisted portion 40 in which the core 30" is not twisted and the bristles 20 are disposed in multiple straight paths that extend generally parallel to the longitudinal axis XX' of the core 30". The opposite end of the core 30" may optionally include a stem 70. The stem 70 facilitates connection of the cosmetic brush to a handle or the like (not shown).

The view presented in FIG. 5 provides a view of the bristles 20 as randomized in the twisted portion 50". The view presented in FIG. 6 provides a view of the bristles 20 as disposed in multiple spiral or helical paths that extend about a portion of the longitudinal axis XX' of the core 30". As such, it can be said that the bristles 20 have an organized randomness.

Figure 7:
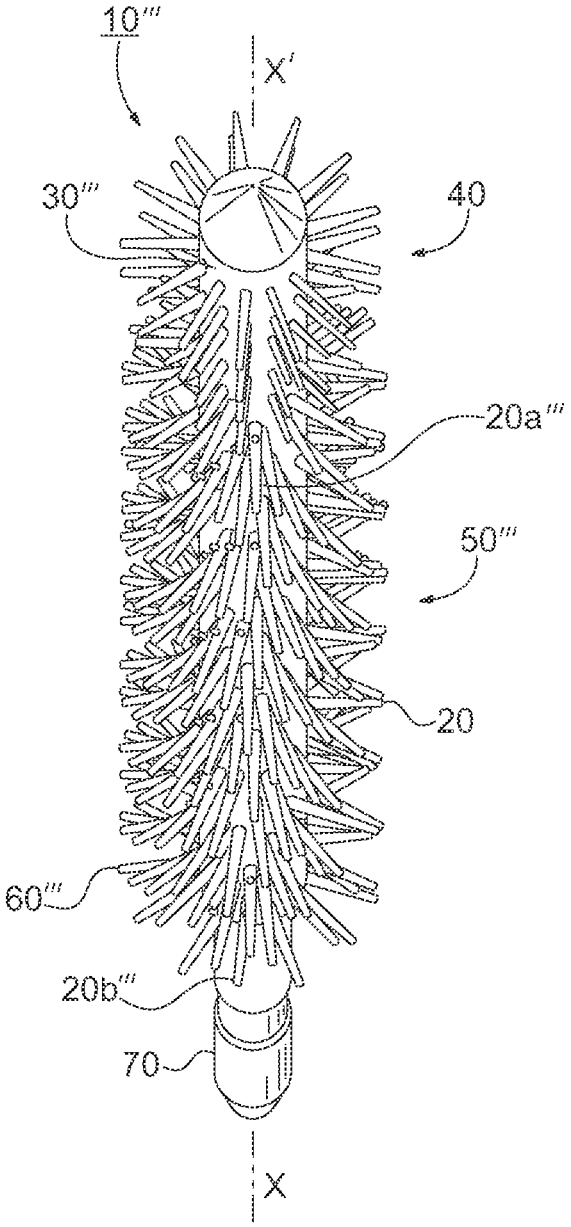
FIG. 7 is a perspective view of a cosmetic brush in accordance with another exemplary embodiment of the invention with at least a portion of the bristles having a 360 degree twist angle.

Referring to FIG. 7, a cosmetic brush 10''' in accordance with another exemplary embodiment of the invention will be described. The brush 10''' includes a plurality of polymer bristles 20 that extend from a polymer core 30''' in a radial direction. In this embodiment, the core 30''' includes a twisted portion 50''' having a twist angle of 360 degrees. Bristles 20 in the twisted portion 50''' are arranged in multiple columns disposed in multiple spiral or helical paths 60''' that extend about a portion of the longitudinal axis XX' of the core 30'''. None of the spiral/helical paths intersect. As illustrated in FIG. 7, the upper most bristle 20*a'''* in the twisted portion 50''' is offset from the lower most bristle 20*b'''* in the twisted portion 50''' by about 360 degrees.

In the illustrated embodiment, the core 30''' also includes an untwisted portion 40 in which the core 30''' is not twisted and the bristles 20 are disposed in multiple straight paths that extend generally parallel to the longitudinal axis XX' of the core 30'''. The opposite end of the core 30''' may optionally include a stem 70. The stem 70 facilitates connection of the cosmetic brush to a handle or the like (not shown).

The view presented in FIG. 7 provides a view of the bristles 20 as disposed in multiple spiral or helical paths 60''' that extend about a portion of the longitudinal axis XX' of the core 30'''. Again, the bristles 20 have an organized randomness.

While this invention has been described with an emphasis upon preferred embodiments, it will be obvious to those of ordinary skill in the art that variations in the preferred compositions and methods can be used and that it is intended that the invention can be practiced otherwise than as specifically described herein. Accordingly, this invention includes all modifications encompassed within the spirit and scope of the invention as defined by the claims that follow.

What is claimed is:

1. A cosmetic brush comprising:

a polymer core extending along a longitudinal axis and defining a first portion thereof extending between a first end of the first portion and a second end of the first portion;

a plurality of polymer bristles extending from the polymer core in a radial direction, wherein at least the first end of the first portion of the core is twisted about the longitudinal axis relative to the second end of the first portion of the core to define a twisted portion and wherein bristles in the twisted portion are arranged in one or more columns disposed in one or more spiral or helical paths about at least a portion of the longitudinal axis of the core, the plurality of polymer bristles integrally molded with the polymer core, wherein the molded polymer core is twisted with a plurality of twist angles via an application of heat such that the plurality of polymer bristles have an organized randomness, wherein an upper most bristle in the twisted portion is offset from a lower most bristle in the twisted portion by one of the plurality of twist angles, wherein the twist angles are angles between two bristles in different rows within the twisted portion, wherein the molded polymer core is twisted with the plurality of twist angles throughout the entire twisted portion, and wherein the plurality of twist angles are distinct from each other.

2. The cosmetic brush of claim 1 wherein the twist of the core is permanently fixed.

3. The cosmetic brush of claim 2 wherein the configuration of each spiral or helical path is permanently fixed.

4. The cosmetic brush of claim 1 wherein each column of bristles in the twisted portion of the core is disposed in a separate spiral or helical path that extends about at least a portion of the longitudinal axis of the core.

5. The cosmetic brush of claim 4 wherein none of the spiral or helical paths intersect with one another.

6. The cosmetic brush of claim 1 wherein one of the plurality of the twist angles is 90 degrees.

7. The cosmetic brush of claim 1 wherein one of the plurality of the twist angles is 180 degrees.

8. The cosmetic brush of claim 1 wherein one of the plurality of the twist angles is 270 degrees.

9. The cosmetic brush of claim 1 further comprising a non-twisted portion of the core with one or more columns of bristles disposed in one or more straight paths that extend substantially parallel to the longitudinal axis of the core.

10. The cosmetic brush of claim 9 wherein none of the straight paths intersect.

11. The cosmetic brush of claim 1 wherein one end of the core defines a stem.

12. The cosmetic brush of claim 11 wherein the stem is configured for connection to a handle.

13. The cosmetic brush of claim 1 wherein the bristles are manufacturing from a thermoplastic material.

14. The cosmetic brush of claim 1 wherein the bristles and the core are manufactured from the same material.

15. The cosmetic brush of claim 1 wherein the brush is configured for use as a mascara brush.

16. The cosmetic brush of claim 1 wherein the brush is configured for use as a hair coloring brush.

* * * * *